US005738465A

United States Patent [19]

Gessay et al.

[11] Patent Number: 5,738,465

[45] Date of Patent: Apr. 14, 1998

[54] DEVICE FOR THE IN-SITU PRODUCTION OF COLUMNS OF STABILIZED AND COMPACTED SOIL

[75] Inventors: Jean-Claude Gessay, Roissy en Brie; Alain Deniau, Creteil, both of France

[73] Assignee: Sondages Injections Forages "S.I.F." Entreprise Bachy, Rueil Malmaison Cedex, France

[21] Appl. No.: 696,117

[22] Filed: Aug. 13, 1996

Related U.S. Application Data

[63] Continuation of Ser. No. 370,244, Jan. 9, 1995, abandoned.

[30] Foreign Application Priority Data

Jan. 14, 1994 [FR] France ..... 94 00380

[51] Int. Cl.[6] ..... E02D 3/12; E21C 1/00

[52] U.S. Cl. ..... 405/266; 405/233; 405/241; 299/57; 299/68

[58] Field of Search ..... 405/233, 241, 405/266; 299/57, 68

[56] References Cited

U.S. PATENT DOCUMENTS

| | | | |
|---|---|---|---|
| 3,305,271 | 2/1967 | Galis et al. | 299/57 |
| 4,537,536 | 8/1985 | Tsubonuma et al. | 405/241 X |
| 4,662,792 | 5/1987 | Gessay . | |
| 5,163,784 | 11/1992 | Kunito | 405/266 X |
| 5,275,513 | 1/1994 | Geary et al. | 405/266 |
| 5,417,522 | 5/1995 | Kono et al. | 405/266 |

FOREIGN PATENT DOCUMENTS

| | | | |
|---|---|---|---|
| 0161974 | 11/1985 | European Pat. Off. . | |
| 0744126 | 6/1980 | U.S.S.R. | 299/57 |
| 2010361 | 6/1979 | United Kingdom . | |

*Primary Examiner*—Tamara L. Graysay
*Assistant Examiner*—Tara L. Mayo
*Attorney, Agent, or Firm*—Watson Cole Stevens Davis P.L.L.C.

[57] ABSTRACT

A device for drilling into the ground for the in-situ production of columns of stabilized and compacted soil, which comprises at least two parallel shafts, each shaft driving in rotation one auger, each auger being fitted with a loosening drill head. The shafts and the shanks of the augers include a bore and at least one orifice for discharging a filler material, the augers having opposite hands and being driven in counterrotation, and which furthermore have a drive for reversing the direction of rotation of the augers, said device including an even number n, at least equal to 4, of augers and in that, as seen in cross-section, the axes of the augers are centered at the vertices of a regular n-sided polygon.

4 Claims, 1 Drawing Sheet

DEVICE FOR THE IN-SITU PRODUCTION OF COLUMNS OF STABILIZED AND COMPACTED SOIL

This application is a Continuation of application Ser. No. 08/370,244, filed Jan. 9, 1995, now abandoned.

BACKGROUND OF THE INVENTION

The invention relates to an improved device for the in situ production of columns of stabilized and compacted soil.

Published European patent application EP-B-0,161,974 or its counterpart U.S. Pat. No. 4,662,792 describes a method for the in-situ production of columns of stabilized and compacted soil. This method includes a first step consisting of forcing into the ground a rotary drilling tool loosening the ground and mixing it with a filler material, and during which step an upward movement, through the drilling tool, is imparted to at least part of the loosened ground. And second step consists of withdrawing the drilling tool from the ground, and is characterized in that a device is used, as a drilling tool, which comprises at least two parallel shafts, each shaft rotationally driving an auger, each auger being fitted at its opposite end to the drive shaft with a loosening drill head and the distance between the axes of the augers being less than the diameter of an auger. The shafts and the shanks of the augers include a bore connected to a source of filler material and at least one orifice communicating with the said bore being provided on the shank of each auger in order to discharge the filler material. The augers have opposite hands and are driven in counterrotation, and which furthermore comprise means for reversing the direction of rotation of the augers, in that the first step is carried out by forcing the said device into the ground while discharging a filler material via the said orifice so as to mix it with the loosened ground and in that the second step is carried out, after having reversed the direction of rotation of the augers, by exerting a controlled bearing force on the said device while it is being withdrawn so as to impart a downward movement, through the said device, to the loosened ground mixed with the filler material, tending to compact it.

Although EP-B-0,161,974 also claims a device suitable for the implementation of the said method, comprising at least two augers, it specifically describes only a two-auger device.

When employing this specific two-auger device in very soft ground, according to the method described, difficulties have been encountered due to the fact that the path of the device can suffer large deviations with respect to the one desired. It is apparent, after studying this phenomenon, which is not perceptible in relatively firm ground, that it results from the dissymmetry of the distribution of the forces which are exerted on the device during operation.

The main forces, which are applied to the augers or drill heads, namely:

the forces resulting from the cutting action the forces due to lateral friction between the augers and the ground, and the forces resulting from the accumulation of materials at the entrance of the imbricated augers, all act in the same direction and tend to impart a movement (translation and/or rotation) to the device with respect to the soil, as well as to exert a torque on the guideway of the drilling machine which serves to guide the multi-auger device.

Normal ground, having good or average mechanical characteristics can develop reactions limiting the reactions induced by the said forces, but this is not so in the case of very soft soils, in particular in sensitive clays, in which the deviations become unacceptable since the reaction forces are insufficient.

The need therefore arises for an improved device which would be free of the abovementioned drawback.

The principal objective of the present invention is precisely to provide such a device.

SUMMARY OF THE INVENTION

More specifically, the invention relates to a device for the in-situ production of columns of stabilized and compacted soil, of the kind which comprises at least two parallel shafts, each shaft driving in rotation one auger, each auger being fitted at its opposite end to the drive shaft with a loosening drill head and the distance between the axes of the augers being less than the diameter of an auger. The shafts and the shanks of the augers include a bore and at least one orifice communicating with the said bore being provided on the shank of each auger in order to discharge a filler material, the augers having opposite hands and being driven in counterrotation, and which furthermore comprises means for reversing the direction of rotation of the augers, said device including an even number n, at least equal to 4, of augers and in that, seen in cross-section, the axes of the augers are centred at the vertices of a regular n-sided polygon.

According to preferred embodiments, the device includes 4, 6 or 8 augers and the axes of the augers are respectively arranged at the vertices of a square, a regular hexagon or a regular octagon.

With such a geometry, a symmetrical device is obtained in which the abovementioned forces are compensated for so that deviations in soft ground are no longer observed.

The device preferably includes a single motor driving, via an appropriate gearbox, all the augers, this being for the purpose of synchronizing the augers in terms of rotation, which is essential on account of their mutual imbrication, but it is obviously not excluded to employ several drive motors if desired, as long as, moreover, means are provided for suitably synchronizing the rotation of the augers.

BRIEF DESCRIPTION OF THE DRAWINGS

The description which follows, with regard to the appended drawings, given by way of non-limiting example, will make it clear how the invention can be realized.

DESCRIPTION OF PREFERRED EMBODIMENTS

Figure 1:
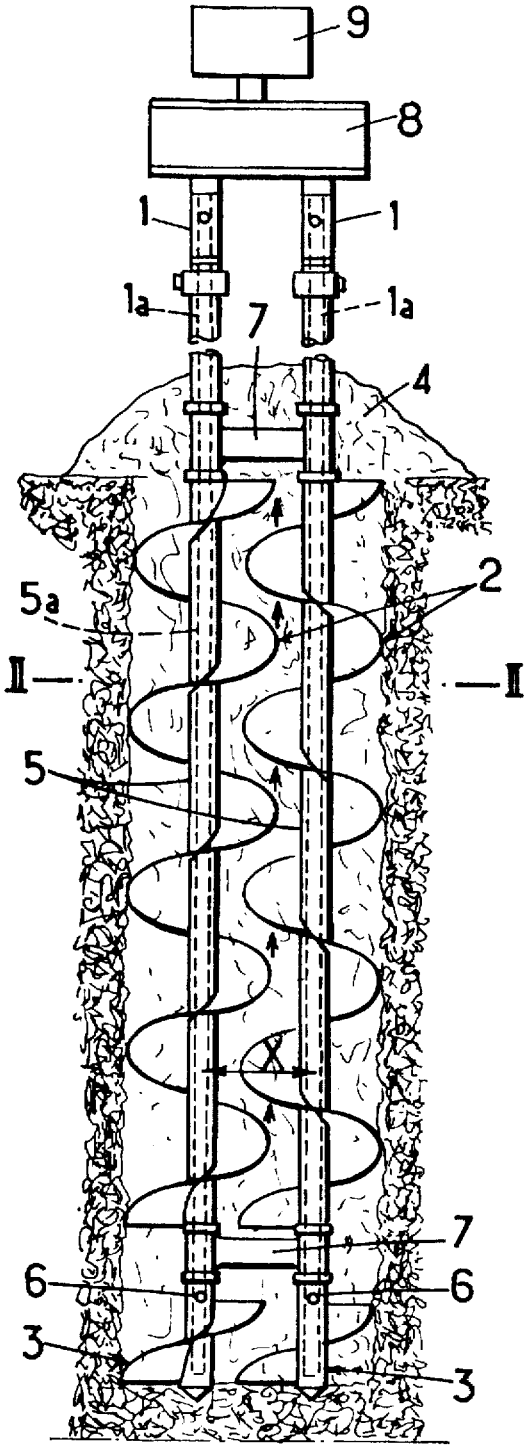
FIGS. 1 and 2 are diagrammatic views, in elevation and in cross-section (along the line II—II) respectively, of one embodiment of the device according to the invention.
Figure 2:
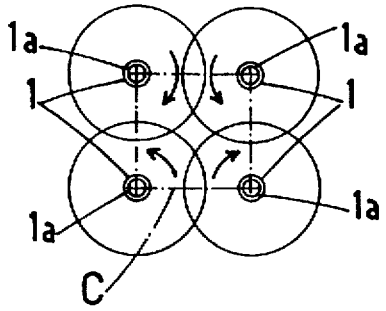

The device depicted in FIGS. 1 and 2 includes the following elements:

Four parallel shafts 1, each provided with a bore la, drive four counterrotating helical augers 2 of opposite hands. The shafts 1 are arranged so that, in cross-section (FIG. 2), their axes are centred at the vertices of an imaginary square C (depicted by the dotted lines). Each auger is fitted at its free end with a loosening drill head 3 adapted to the nature of the ground. This can be, for example, as illustrated, a head in the form of a helix or else a cutter. The distance X between the adjacent axes of the augers is less than the diameter of the augers so that the threads of the adjacent augers are effectively engaged one in another so as to provide a forced movement or flow of the ground 4 loosened by the augers. The shank 5 of each auger also includes a bore 5*a* which communicates with the bore of the corresponding driving shaft, thus enabling the filler material or binder, coming from a source (not depicted), by dry route or by wet route, to be brought right to the orifices 6 provided on the shank of each auger so as to mix it intimately with the loosened ground.

The length of the augers is adapted to the type of ground and it is usually less than the depth of the column to be produced.

It should be noted that the augers, instead of having a continuous helical profile, could be discontinuous, that is to say be replaced by a plurality of separated helices.

A few double bearings 7, depending on the depth of the column to be produced, are distributed over the length of the driving shafts and of the augers so as to keep them parallel.

The four shafts 1 are driven in rotation by means of a geared speed-reducing and reversing device 8, itself connected to a motor 9 which drives them, as well as the augers, in rotation in opposite directions and at the same speed. This gear-motor assembly 8–9 can be carried by a drilling machine (not depicted) installed on the surface in line with the column to be produced or by means of a guideway on which it can move longitudinally, either freely or by means of a translation device. As a variant, it can be hung from the jib of a lifting contrivance (a crane or other means). In the latter case, the weight of the device can be adapted so that it exerts the desired bearing force.

Figure 3:
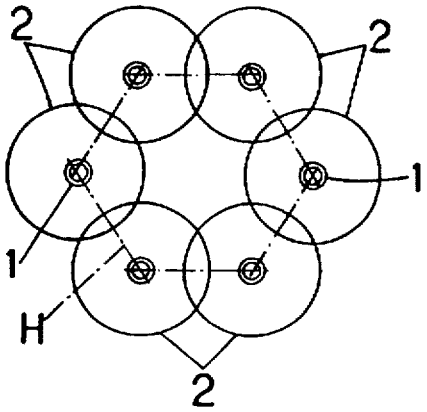
FIGS. 3 and 4 are diagrammatic views, in cross-section, in the region of the augers, of other embodiments of the device of the invention.

FIG. 3 illustrates diagrammatically a device similar to the one of FIGS. 1 and 2 save that it includes six augers 2 instead of four. The shafts 1 of these augers are arranged so that, in cross-section, their axes are centred at the vertices of an imaginary regular hexagon H (shown by the dotted lines).

Figure 4:
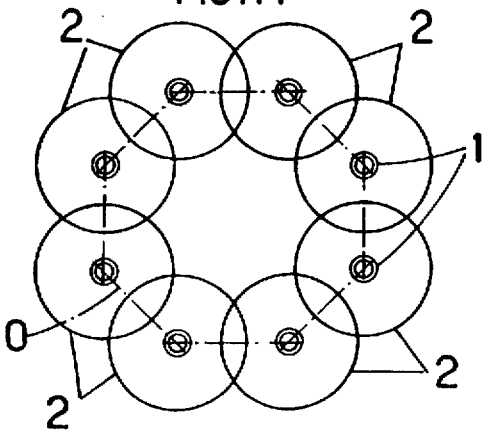

FIG. 4 illustrates diagrammatically a device similar to the one of FIGS. 1 and 2, save that it includes eight augers 2 instead of four. The shafts 1 of these augers are arranged so that, in cross-section, their axes are centred at the vertices of an imaginary regular octagon ○ (shown by the dotted lines).

The improved device of the invention is used in the same manner as the device described in EP-B-0,161,974 to which reference should be made for more details.

However, because of the symmetrical nature of the device of the invention, it is free, when being used in soft ground, of the drawback exhibited by the device of EP-B-0,161,974, this drawback being recalled in the preamble of the present description.

It goes without saying that the embodiments described are only examples and they could be modified, especially by substituting with technical equivalents, without thereby departing from the scope of the invention.

We claim:

1. Device for the in-situ production of columns of stabilized and compacted soil, which comprises at least four parallel shafts, each shaft driving in rotation one auger, each auger being fitted at its opposite end to a drive shaft with a loosening drill head, the distance between the axes of adjacent augers being less than the diameter of each of said augers, the shaft and the shank of each of said auger including a bore and at least one orifice communicating with said bore being provided on the shank of each auger in order to discharge a filler material, said device including means to maintain a non-deviant path of travel, even in soft soil, said means comprising adjacent augers having opposite hands and means for driving said adjacent augers in counterrotation, with the number of said augers being an even number n, at least equal to 4, and arranged so that, as seen in cross-section, the axes of said augers are centered at the vertices of a regular n-sided polygon, said device furthermore comprises means for reversing the direction of rotation of the augers.

2. Device according to claim 1, which includes four augers, the axes of which, in cross-section, are centred at the vertices of an imaginary square.

3. Device according to claim 1, which includes six augers, the axes of which, in cross-section, are centred at the vertices of an imaginary regular hexagon.

4. Device according to claim 1, which includes eight augers, the axes of which, in cross-section, are centred at the vertices of an imaginary regular octagon.

* * * * *